US005336069A

United States Patent [19]

Matsuyama

[11] Patent Number: 5,336,069

[45] Date of Patent: Aug. 9, 1994

[54] ROTARY PISTON FLUID PUMP

[75] Inventor: Tatsuo Matsuyama, Gunma, Japan

[73] Assignee: Ogura Clutch Co., Ltd., Kiryr, Japan

[21] Appl. No.: 69,088

[22] Filed: May 28, 1993

[30] Foreign Application Priority Data

Mar. 15, 1993 [JP] Japan ..... 5-78651

[51] Int. Cl.[5] ..... F01C 1/18

[52] U.S. Cl. ..... 418/206; 418/150

[58] Field of Search ..... 418/206, 205, 150

[56] References Cited

U.S. PATENT DOCUMENTS 3,817,667 6/1974 Winkelstrater et al. ..... 418/206
4,648,817 3/1987 Mariani ..... 418/206
5,039,289 8/1991 Eiermann et al. ..... 418/206

FOREIGN PATENT DOCUMENTS 1403517 11/1968 Fed. Rep. of Germany ..... 418/206
63-248992 10/1988 Japan .
3-38434 6/1991 Japan .

*Primary Examiner*—Richard A. Bertsch
*Assistant Examiner*—Charles G. Freay
*Attorney, Agent, or Firm*—Blakely, Sokoloff, Taylor & Zafman

[57] ABSTRACT

In a fluid pump, a pair of rotors having different rotation phases and designed to come into slidable contact with each other are rotatably contained in a rotor housing so as to be brought into slidable contact with a housing inner wall, and a large arcuated surface having the same radius of curvature as that of a housing inner circumferential surface and a small arcuated surface having a radius of curvature obtained by subtracting a radius of the large arcuated surface from a distance between axes of the rotors are formed on an outer circumferential surface of each of the rotors. A transitional surface crossing a virtual boundary line extending from a rotor center at an angle of 45° with respect to central axes of the large and small arcuated surfaces, which transitional surface is an outer surface, of the outer circumferential surface of each of the rotors, located between the large and small arcuated surfaces, is formed by an outer transitional surface constituted by a plurality of continuous convex surfaces extending from an intersection between the virtual boundary line and the transitional surface to an edge of the large arcuated surface and an inner transitional surface constituted by a plurality of continuous concave surfaces extending from the intersection to an edge of the small arcuated surface.

8 Claims, 7 Drawing Sheets

ROTARY PISTON FLUID PUMP

BACKGROUND OF THE INVENTION

The present invention relates to a fluid pump applied to an air pump constituted by a displacement blower used as a supercharger for an internal combustion engine and, more particularly, to the structure of a rotor.

The two-lobe rotors of displacement blowers constituting air pumps are roughly classified into cycloid type rotors constituted by epicycloid and hypocycloid curves, and envelope type rotors which are designed such that the inner transitional surface of one rotor serves as the envelope curve of the outer transitional surface of the other rotor.

Such a two-lobe blower is mounted, as a supercharger for an internal combustion engine, in a vehicle, as shown in, e.g., FIGS. 5 and 6. FIGS. 5 and 6 show states in which conventional pumps are mounted in internal combustion engines. A blower (S/C) a shown in FIG. 5 is rotated/driven by the operation of an electromagnetic clutch i coupled to an engine (Eng) b through a belt c. The blower a is designed to pressurize air supplied through an air cleaner e, an air flowmeter f, and an inlet pipe g, and distribute the pressurized air to each combustion chamber of the engine b through a slot valve d and a surge tank h. A blower (S/C) a shown in FIG. 6 is interposed between an engine b and a slot valve d and is designed to equally distribute pressurized air to each combustion chamber of the engine b.

As such a displacement blower, the blower disclosed in U.S. Pat. No. 5,039,289 (to be referred to as a Wankel blower hereinafter) is a representative blower. The rotor shape of this Wankel blower will be described below with reference to FIGS. 7 and 8. FIG. 7 shows only the first quadrant of a coordinate system defined by the center line of a large arcuated surface (to be described later) as the X axis and the center line of a small arcuated surface (to be described later) as the Y axis. FIG. 8 shows a meshed state of rotors. FIG. 8 shows only part of the rotors.

A rotor 1 of a Wankel blower has a large arcuated surface 2 having a radius R and inclining at an angle of about 25° with respect the X axis, and a small arcuated surface 3 having a radius r and inclining at an angle of about 45° with respect to the Y axis. In contrast to a general Roots blower, the Wankel blower has a good sealing property. A side surface connecting the large arcuated surface 2 to the small arcuated surface 3 includes an inner transitional surface 4 constituted by a flat surface overlapping a straight line $1_1$ inclining at an angle $\alpha$ (45°) with respect to the X axis and passing through a center O, and an outer transitional surface 5 constituted by a flat surface overlapping a straight line $1_2$ crossing the straight line $1_1$ at an angle $\beta$ (120°). The small arcuated surface 3 and the inner transitional surface 4 are connected to each other through an arcuated surface 6 constituted by a concave surface. The inner transitional surface 4 and the outer transitional surface 5 are connected to each other through a convex surface 7 constituted by, e.g., an epicycloid curve or a circular curve. Note that a neck denoted by reference numeral 8 in FIGS. 7 and 8, at which the outer transitional surface 5 and the large arcuated surface 2 cross each other, is not specifically chamfered.

Each rotor 1, of the Wankel blower, which has the above-described shape is designed as follows. Provided that a distance (inter-axis distance) $O_1O_2$ between central points $O_1$ and $O_2$ of the rotor 1 is 2L the relationship between the radius r of the small arcuated surface 3 and the radius R of the large arcuated surface 2 is given by $r=2L-R$, and the radii r and R are determined by the distance between rotation axes (to be described later). In addition, the inner transitional surface 4 and the outer transitional surface 5 have a boundary line of an angle of 45°, and the inner transitional surface can be formed by a cycloid curve or an envelope curve.

The inner and outer transitional surfaces 4 and 5 of each rotor 1 of the Wankel blower are constituted by flat surfaces so that the surfaces 4 and 5 of the respective rotors 1 are meshed with each other at an angle, unlike a pair of rotors of a general Roots blower which are meshed with each other to smoothly roll. With this arrangement, at the instant that the two transitional surfaces 4 and 5 are meshed with each other, a triangular closed space (to be referred to as a dead space hereinafter, although it is described as a gas pocket in the official gazette) S is formed between the two rotors. Since the dead space S is not quickly released and narrowed upon rotation of the rotors 1, a problem tends to occur in the Wankel blower as pressurized air in the dead space S is pressurized, and a drive resistance for driving the blower can be reduced.

Although the Wankel blower is advantageous in reducing the drive resistance, various problems are posed in practical applications.

More specifically, the dead space S causing a loss volume is large, and the loss volume reaches about 5% of the inlet air amount, resulting in a low volumetric efficiency. In addition, an increase in the temperature of the blower itself is very large, and the blower produces large noise.

In consideration of these drawbacks of the Wankel blower, displacement blowers having improved rotors are disclosed in Japanese Patent Publication No. 3-38434 (to be referred to as the former hereinafter) and Japanese Patent Laid-Open No. 63-248992 (to be referred to as the latter hereinafter). The rotors of these blowers will be described below with reference to FIGS. 9 and 10.

FIG. 9 shows part of a rotor of a conventional air pump disclosed in Japanese Patent Publication No. 3-38434. FIG. 10 shows part of a rotor of a conventional air pump disclosed in Japanese Patent Laid-Open No. 63-248992. As shown in FIG. 9, a rotor 9 of the former has an outer transitional surface 12, constituted by an epicycloid curve, and an inner transitional surface 13, constituted by a hypocycloid curve, which are formed between a small arcuated surface 10 and a large arcuated surface 11 to connect them to each other.

As shown in FIG. 10, a rotor 14 of the latter has an outer transitional surface 17, constituted by an arcuated surface, and an inner transitional surface 18, constituted by an envelope curve, which are formed between a small arcuated surface 15 and a large arcuated surface 16 to connect them to each other such that the central points of the surfaces 17 and 18 coincide with each other on the X axis.

With the above-described rotor shapes, the loss volumes of these two air pumps are greatly reduced to improve the volumetric efficiencies. In addition, an increase in temperature and the generation of noise can be suppressed.

The following problems, however, are expected when the two blowers described above are examined in detail.

Assume that the blower of the former is in a meshed state such as the one shown in FIG. 8. In this case, the inner transitional surface 13 constituted by the hypocycloid curve opposes the outer transitional surface 12 constituted by the epicycloid curve with a design clearance, while the slidable contact surface of the small arcuated surface 10 of one rotor 9 opposes the slidable contact surface of the large arcuate surface 11 of the other rotor 9 with a design clearance.

Immediately before such a meshed state is attained, the outer transitional surface 12, of one rotor 9, constituted by the epicycloid curve, and the inner transitional surface 13, of the other rotor 9, constituted by the hypocycloid curve, are meshed with each other to smoothly roll with the design clearance. For this reason, when the pair of rotors roll while they are meshed with each other, the volume of a wedge-like space formed between the two rotors changes. That is, similar to a general Roots blower, as the wedge-like space formed between the rotors is narrowed, pressurized air in the space is further pressurized to increase the drive resistance. Note that a similar problem may be posed in the blower of the latter.

If, as in the above-described two blowers, rotors having transitional surfaces constituted by small and large arcuated surfaces, cycloid curves, and envelope curves are designed to be sequentially meshed with each other to roll, the clearance formed between a pair of rotors while the rotors roll varies, so that the rotors cannot always be caused to roll in slidable contact with a constant clearance.

SUMMARY OF THE INVENTION

It is an object of the present invention to solve the problems described above, and provide a fluid pump which has a higher volumetric efficiency than a Wankel blower, and can suppress an increase in temperature and the generation of noise.

In order to achieve the above object, according to the present invention, there is provided a fluid pump in which a pair of rotors having different rotation phases and designed to come into slidable contact with each other are rotatably contained in a rotor housing so as to be brought into slidable contact with a housing inner wall, and a large arcuated surface having the same radius of curvature as that of a housing inner circumferential surface and a small arcuated surface having a radius of curvature obtained by subtracting a radius of the large arcuated surface from a distance between axes of the rotors are formed on an outer circumferential surface of each of the rotors, wherein a transitional surface crossing a virtual boundary line extending from a rotor center at an angle of 45° with respect to central axes of the large and small arcuated surfaces, which transitional surface is an outer surface, of the outer circumferential surface of each of the rotors, located between the large and small arcuated surfaces, is formed by an outer transitional surface constituted by a plurality of continuous convex surfaces extending from an intersection between the virtual boundary line and the transitional surface to an edge of the large arcuated surface and an inner transitional surface constituted by a plurality of continuous concave surfaces extending from the intersection to an edge of the small arcuated surface.

DESCRIPTION OF THE PREFERRED EMBODIMENT

An embodiment of the present invention will be described in detail below with reference to FIGS. 1 to 4.

Figure 1:
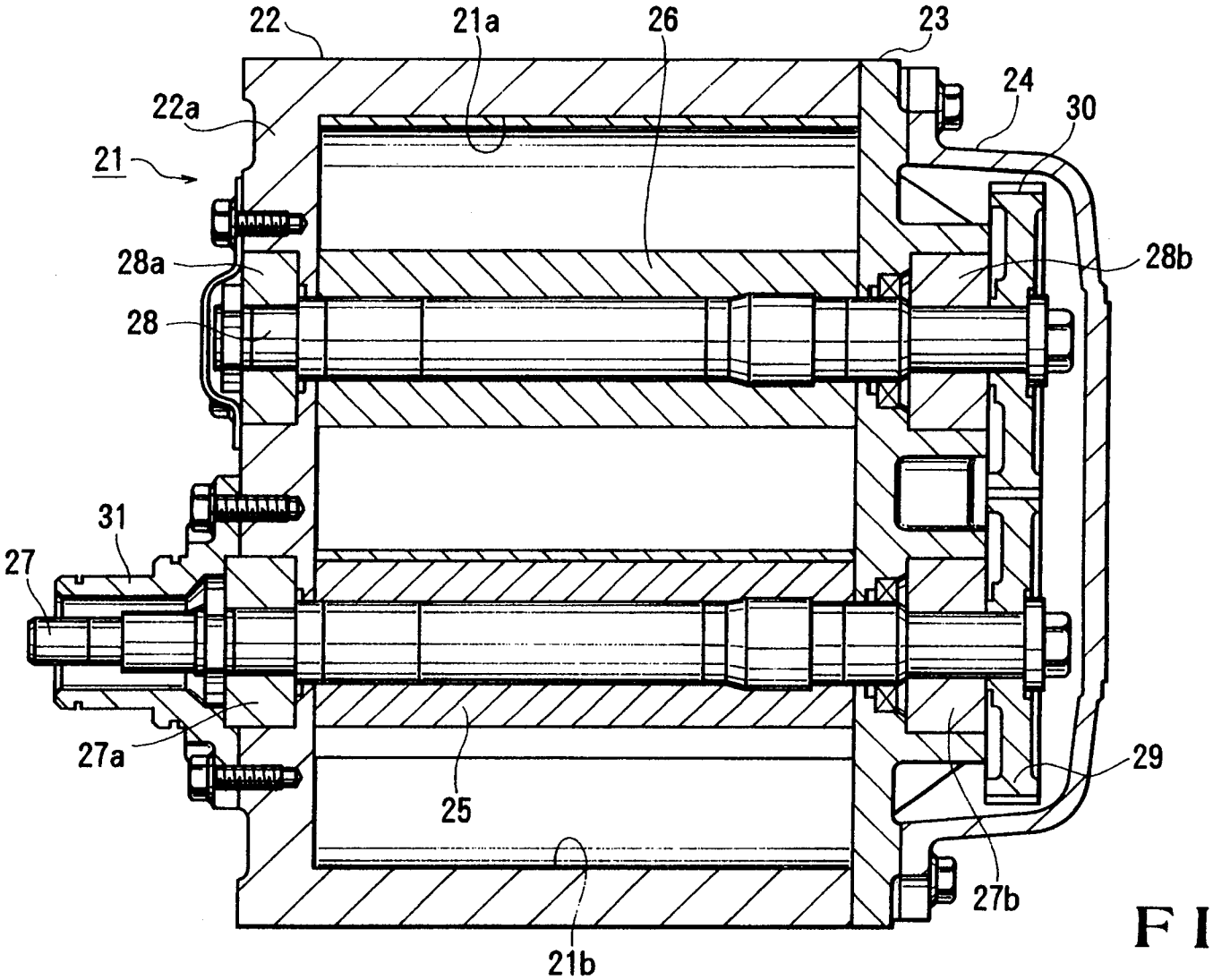
FIG. 1 is a sectional view of an air pump according to the present invention.
Figure 2:
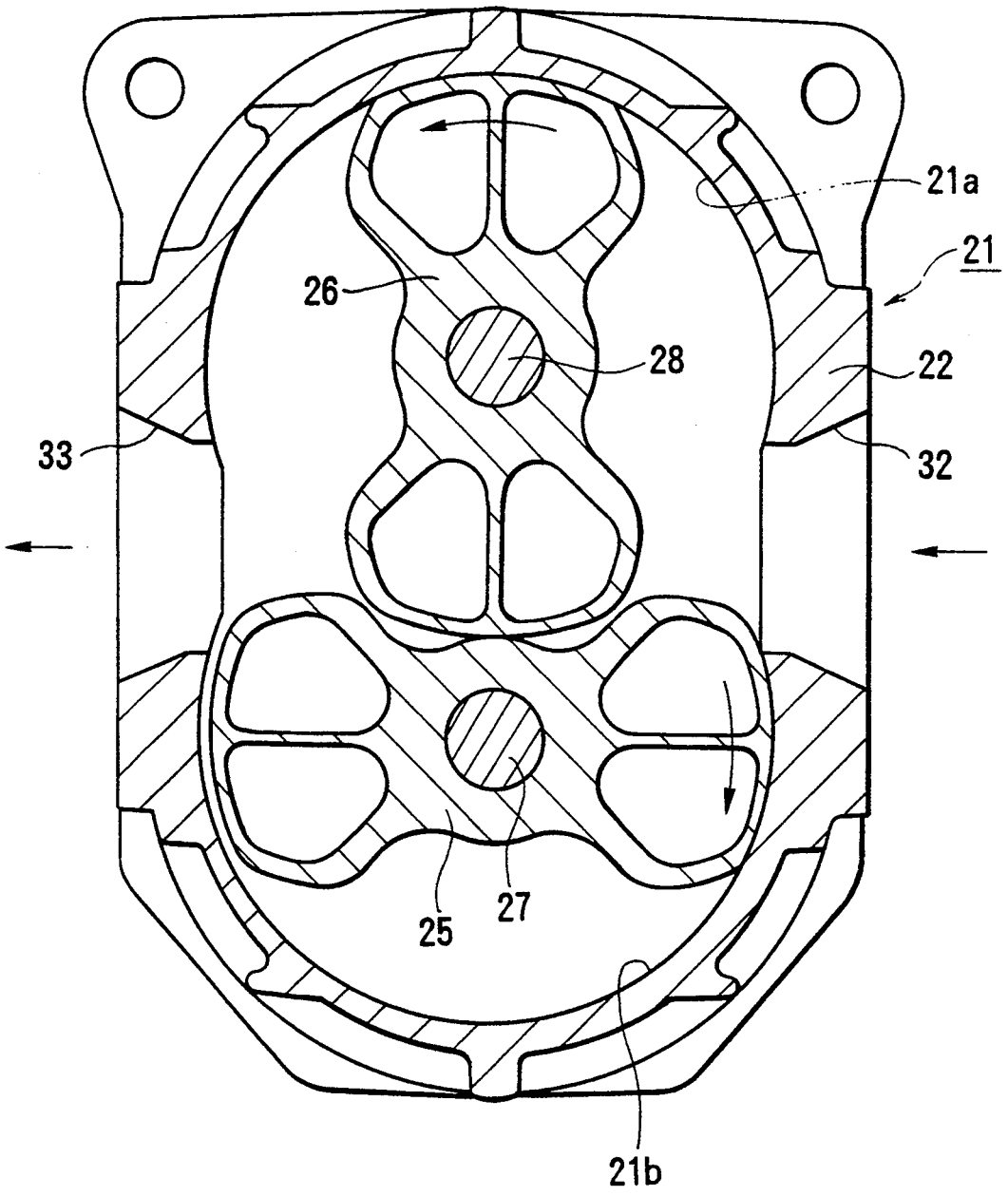
FIG. 2 is a sectional view taken along a line II—II in FIG. 1.
Figure 3:
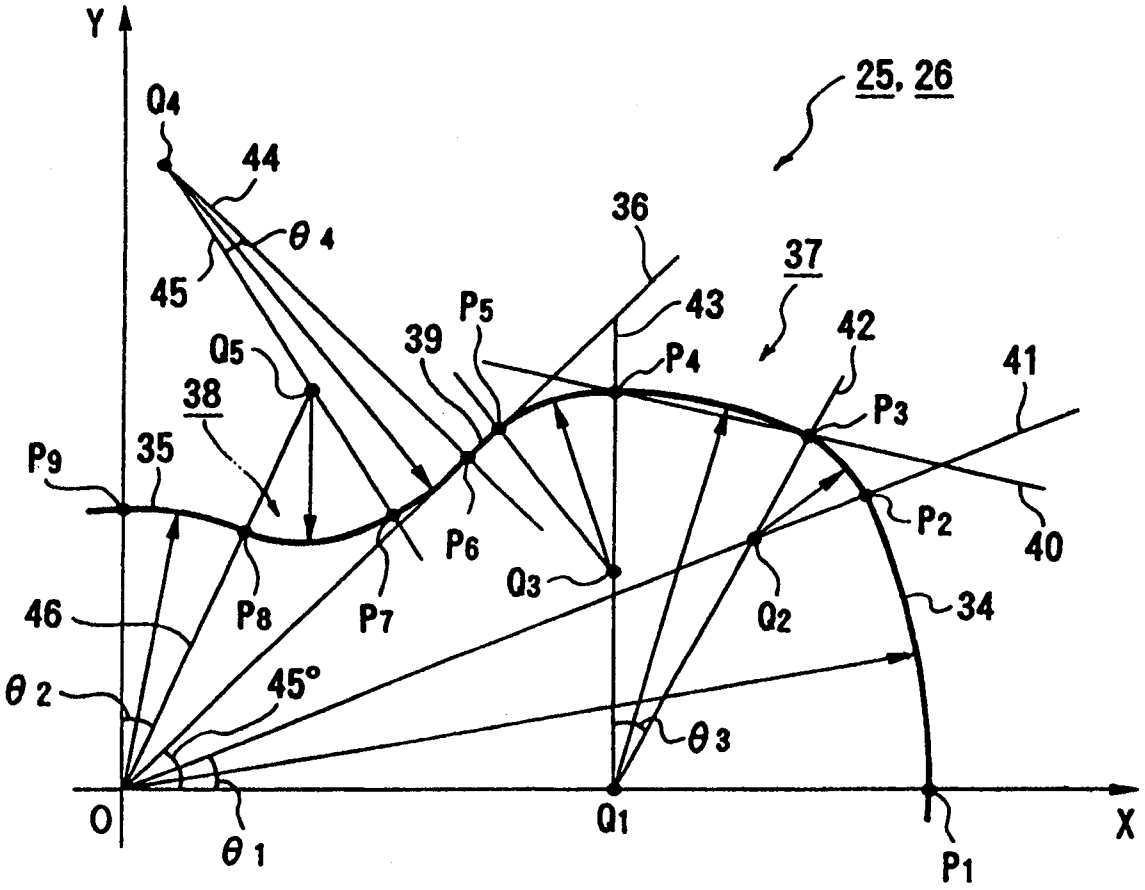
FIG. 3 is a partially enlarged view of a rotor of the air pump according to the present invention, showing a portion corresponding to the first quadrant defined by the coordinate axes X and Y passing through the center of the rotor.
Figure 4:
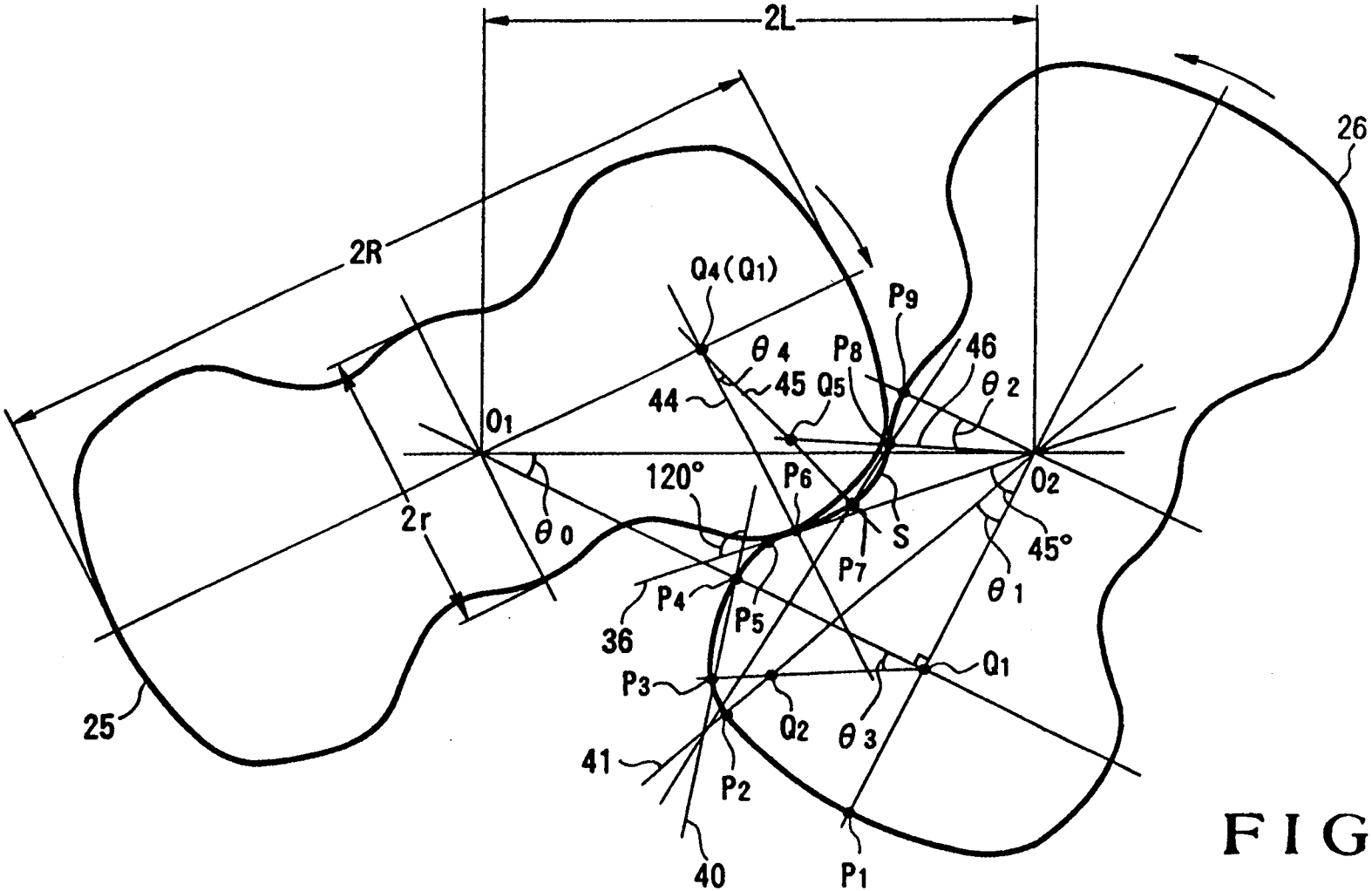
FIG. 4 is a view showing a meshed state of rotors used for the air pump according to the present invention.
Figure 5:
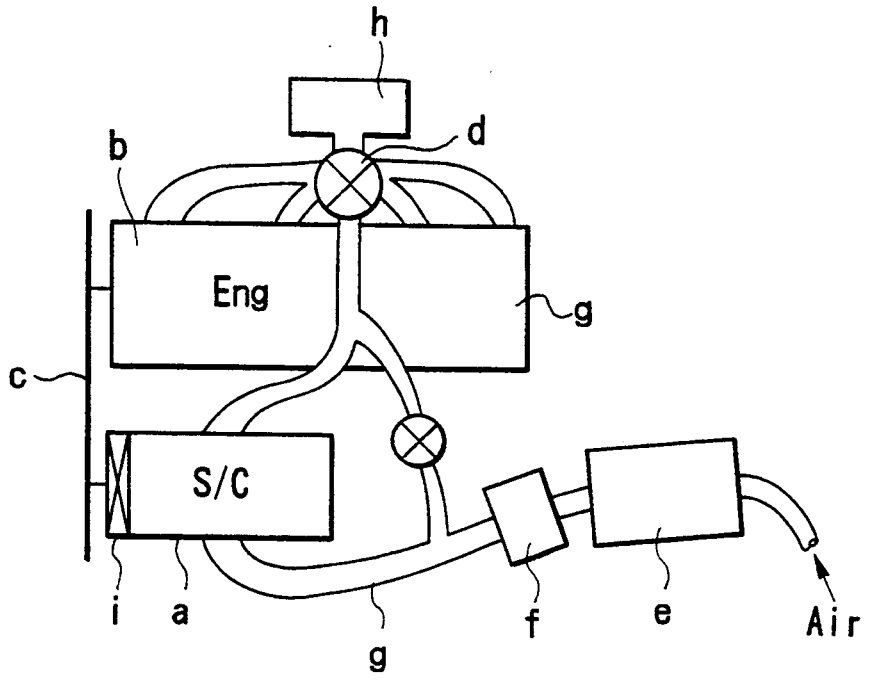
FIG.5 PRIOR ART
FIG. 5 is a schematic view showing a state in which a conventional air pump is mounted in an internal combustion engine.
Figure 6:
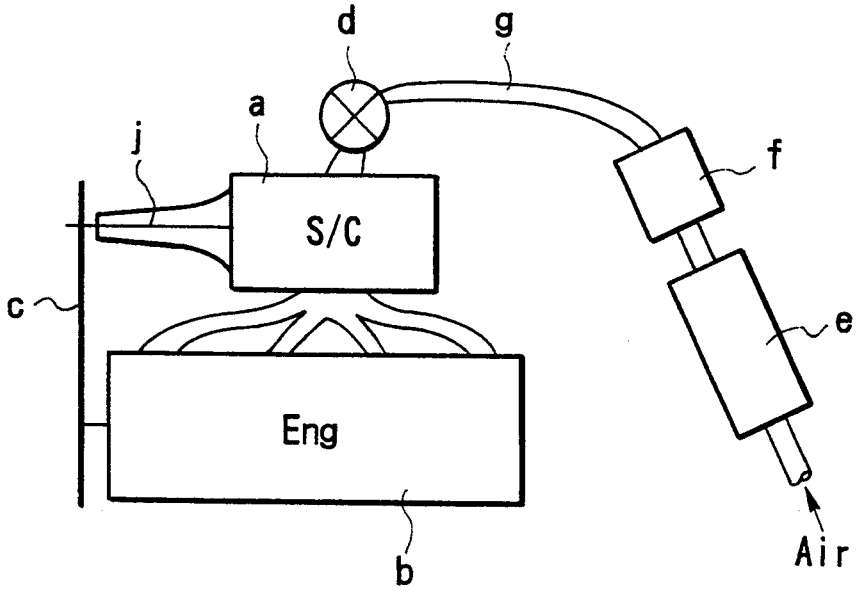
FIG.6 PRIOR ART
FIG. 6 is a schematic view showing another state in which a conventional air pump is mounted in an internal combustion engine.
Figure 7:
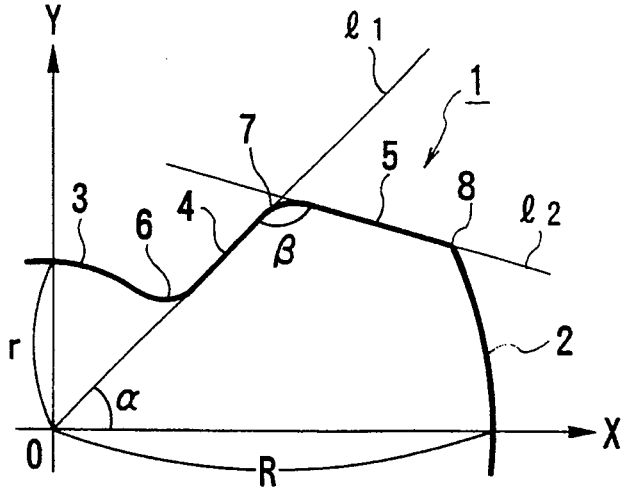
FIG.7 PRIOR ART
FIG. 7 is an enlarged view of a rotor used for a conventional air pump, showing only the first quadrant of a coordinate system defined by the center line of a large arcuated surface as the X axis and the center line of a small arcuated surface as the Y axis.
Figure 8:
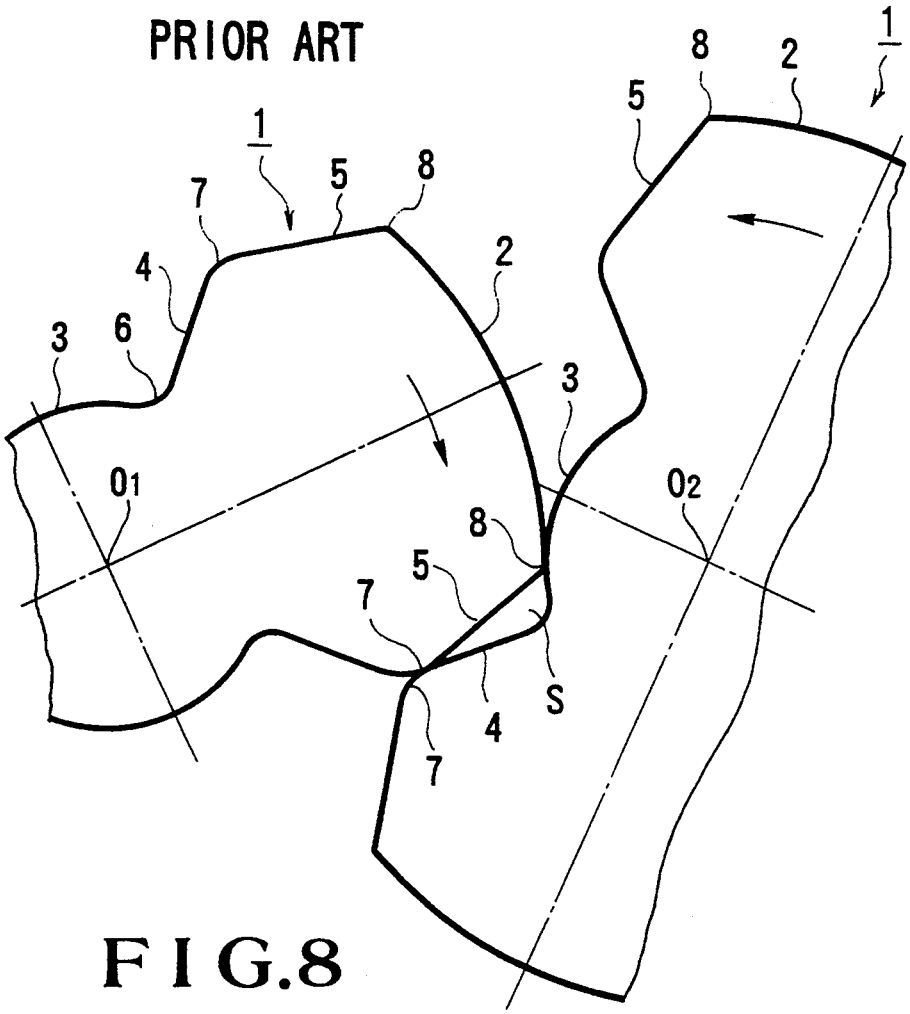
FIG.8 PRIOR ART
FIG. 8 is a sectional view showing a meshed state of rotors in a conventional air pump.
Figure 9:
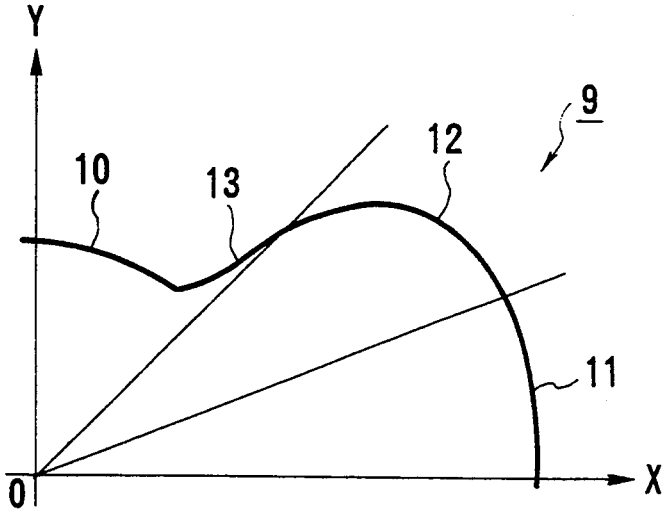
FIG.9 PRIOR ART
FIG. 9 is a partially enlarged view of a rotor of a conventional air pump disclosed in Japanese Patent Publication No. 3-38434.
Figure 10:
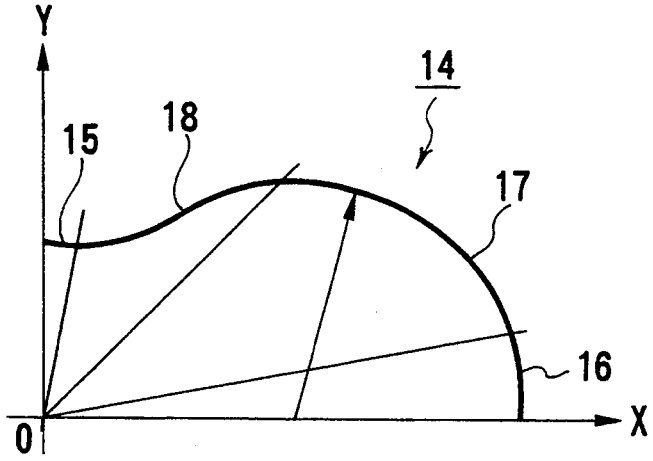
FIG.10 PRIOR ART
FIG. 10 is a partially enlarged view of a rotor of a conventional air pump disclosed in Japanese Patent Laid-Open No. 63-248992.

FIGS. 1 and 2 show an air pump according to the present invention. FIG. 3 shows part of a rotor of the air pump according to the present invention. More particularly, FIG. 3 shows a portion corresponding to the first quadrant defined by the coordinate axes X and Y passing through the center of the rotor. FIG. 4 shows a meshed state of rotors used for the air pump according to the present invention. In this embodiment, the air pump according to the present invention is applied to a supercharger for an internal combustion engine.

Referring to FIGS. 1 to 4, reference numeral 21 denotes an internal combustion engine supercharger as the air pump according to the present invention. The supercharger 21 has a housing constituted by a main body housing 22 having a substantially cylindrical shape with a bottom, a rear housing 23 which is in tight contact with an opening portion of the main body housing 22 through a sealing member (not shown) to close the opening, and a rear cover 24 fixed to the outer portion of the rear housing 23 through a sealing member (not shown).

In the main body housing 22, columnar spaces **21*a* and 21*b* having the same shape are formed at upper and lower positions, respectively. The columnar spaces 21*a* and 21*b* are formed to be parallel to each other such that a lower portion of the columnar space 21*a* on the upper side is stacked on an upper portion of the columnar space 21*b* on the lower side. Rotors 25 and 26 (to be described later) are slidably fitted in the columnar spaces 21*a* and 21*b***, respectively.

The rotors 25 and 26 are respectively fixed to a driving shaft 27 and a driven shaft 28 extending through the main body housing 22 and the rear housing 23 along the axial direction of the columnar spaces 21*a* and 21*b*. Note that these rotors 25 and 26 are fixed to the respective shafts while the cycles of the rotors are shifted from each other by 90°. The driving shaft 27 and the driven shaft 28 are rotatably supported by the main body housing 22 and the rear housing 23 through bearings 27*a* and 27*b*, and 28*a* and 28*b*, respectively. Gears 29 and 30 are respectively fixed to the shaft end portions extending into the rear cover 24 so as to be meshed with each other. With this structure, when the driving shaft 27 is rotated, its rotational force is transmitted to the driven shaft 28 through the gears 29 and 30. The driven shaft 28 is rotated in a direction opposite to the rotational direction of the driving shaft 27.

The end portion, of the driving shaft 27, which extends through a bottom portion 22*a* of the main body housing 22 to protrude outside the housing is coupled to the engine side through an electromagnetic clutch (not shown). Note that the electromagnetic clutch is mounted on a cylindrical member 31 fixed to the bottom portion 22*a*.

Referring to FIG. 2, reference numeral 32 denotes an inlet port; 33, and an outlet port. Both the ports 32 and 33 are formed in the main body housing 22.

In the supercharger 21 having the above-described arrangement, when the electromagnetic clutch is set in a power transmitted state while the engine is operated, the driving shaft 27 and the driven shaft 28 are rotated by the power of the engine, and the rotors 25 and 26 roll in the main body housing 22 while they are synchronously rotated and meshed with each other. Subsequently, air supplied through the inlet port 32 is pressurized, and the pressurized air is discharged from the outlet port 33 to be equally distributed to the respective combustion chambers of the engine (not shown).

A rotor shape as the gist of the present invention will be described next with reference to FIGS. 3 and 4. In FIGS. 3 and 4, the central hole of a rotor or holes formed therein to reduce the weight of the rotor are omitted.

According to the rotor shape, of $\frac{1}{4}$ of the rotor, which corresponds to the first quadrant of the coordinate system shown in FIG. 3, the rotor 25 (identical to the rotor 26) has a contour shape constituted by a curved surface $P_1P_2$, a curved surface $P_2P_3$, a curved surface $P_3P_4$, a curved surface $P_4P_5$, a flat surface $P_5P_6$, a curved surface $P_6P_7$, a curved surface $P_7P_8$, and a curved surface $P_8P_9$, which surfaces are viewed from an intersection $P_1$ on the X axis in the counterclockwise direction. Note that a point $P_9$ is an intersection on the Y axis.

The curved surface $P_1P_2$ is a large arcuated surface 34 which is centered on a central point O of the rotor 25, and has a radius R and an angle $\theta_1$ (about 25° in the embodiment). The curved surface $P_8P_9$ is a small arcuated surface 35 which is centered on the central point O, and has a radius r and an angle $\theta_2$ (about 25° in the embodiment). The large arcuated surface 34 and the small arcuated surface 35 are formed to satisfy $r=2L-R$, provided that a distance (inter-axis distance) $O_1O_2$ between the rotating shafts (the driving shaft 27 and the driven shaft 28) is 2L.

With respect to a virtual boundary line 36 passing through the central point O and inclining at 45°, a side surface of the rotor 25 has an outer transitional surface 37 on the large arcuated surface 34 side, an inner transitional surface 38 on the small arcuated surface 35 side, and a flat surface 39 on a virtual boundary line 36 connecting the outer transitional surface 37 to the inner transitional surface 38. The curved surface $P_3P_4$ on the outer transitional surface 37 is an arcuated surface which is centered on a point $Q_1$ on the X axis and has an angle $\theta_3$. Since the point $Q_1$ is located on the longitudinal axial line (X axis) of one rotor 26, a straight line $O_1Q_1$ connecting a central point $O_1$ of the other rotor 25 to the point $Q_1$ crosses the longitudinal axis line at a right angle in a given cycle.

As shown in FIG. 4, the cycle corresponds to an intake stroke after a stroke for discharging pressurized air, i.e., the time when a dead space S (closed space) to be described later is instantaneously formed.

Assume that a triangle $\Delta O_1O_2Q_1$ is drawn, and that a corner $O_1Q_1O_2=\pi/2$, and the angle of a corner $O_2O_1Q_1$ is represented by $\theta_0$. In this case, a distance $O_2Q_1$ between points $O_2$ and $Q_1$ is given by $O_2Q_1=2\text{-}L\sin\theta_0$ (because $O_1O_2=2L$), and the angle $\theta_0$ is an angle formed immediately before a leading end portion (point $P_8$) (in the rotational direction) of the small arcuated surface 35 of one rotor 26 and a leading end portion (point $P_2$) (in the rotational direction) of the large arcuated surface 34 of the other rotor 25 oppose each other through a design clearance.

Points $P_3$ and $P_4$ at both ends of the curved surface $P_3P_4$ of the outer transitional surface 37 which is centered on the point $Q_1$ are intersections with a straight line 40 crossing the virtual boundary line 36, which passes through the central point and inclines at 45°, at an angle of 120°.

The curved surface $P_3P_4$ of the outer transitional surface 37 has the curved surface $P_2P_3$ and $P_4P_5$ respectively connected to the point $P_2$ as an edge of the large arcuated surface 34 and to a point $P_5$ on the straight line 36.

The curved surface $P_2P_3$ is an arcuated surface which is centered on an intersection $Q_2$ between a straight line 41 passing through the point $P_2$ as an edge of the large arcuated surface 34 and a straight line 42 passing through the point $Q_1$ and the point $P_3$. The curved surface $P_4P_5$ is an arcuated surface which is centered on a point $Q_3$ on a straight line 43 passing through the points $Q_1$ and $P_4$ and the central point $O_1$ of the mating rotor.

The curved surfaces $P_6P_7$ and $P_7P_8$ of the inner transitional surface 38 will be described next.

the curved surface $P_6P_7$ is an acuated surface which is centered on a point $Q_4$. The curved surfaces $p_6P_7$ and $P_3P_4$ are arcuated surfaces having almost the same radius. The curved surface $P_7P_8$ is an arcuated surface which is centered on an intersection $Q_5$ between a straight line 45, shifted, about the point $Q_4$ of the other rotor 25 by an angle $\theta_4$, from a straight line 44 connecting to the point $Q_4$ to a point $P_6$, and a straight line 46 passing through a point $P_8$ as an end of the small arcuated surface 35.

The air pump having the above-described arrangement is accelerated/driven upon reception of power extracted from the crank shaft of the engine through the electromagnetic clutch. The pair of rotors 25 and 26 are caused to synchronously roll in opposite direction when the pair of gears 29 and 30 constituting a power transmission mechanism are meshed with each other. While the rotors 25 and 26 come into slidable contact with the inner traveling surfaces constituting the columnar spaces 21*a* and 21*b* of the main body housing 22 with a predetermined clearance, they are caused to roll, mesh with each other, and rotate. In addition, the air pump pressurizes air supplied through the inlet port 32 via air cleaner and an air flowmeter, and equally distributes the pressurized air to the respective combustion chambers of the engine.

The pair of rotors 25 and 26, which are caused to synchronously roll while sequentially forming a cycle, are designed such that when the point $P_2$ as an end (in the rotational direction) of the large arcuated surface 34 of one rotor 25 opposes the point $P_8$ as an end (in the rotational direction) of the small arcuated surface 35 of the other rotor 26 with a predetermined clearance, the curved surface $P_4P_5$ of the outer transitional surface 37 of one rotor 25 opposes the flat surface 39 of the other rotor 26 with a predetermined clearance. In such a cycle, the dead space S is formed by the curved surface $P_3P_4$ of the outer transitional surface 37 of one rotor 25 and the curved surface $P_7P_8$ of the inner transitional surface 38 of the other rotor 26.

Since the dead space S is not a triangular closed space as in the Wankle blower but a substantially crescent closed space , the volume of the dead space S becomes smaller than that of the closed space in the Wankle blower. Therefore, the volumetric efficiency is improved.

It was found from tests conducted by the applicant of the present invention that the volumetric efficiency was improved by about 6% at 3,000 rpm, and about 4% at 8,000 rpm, with respect to the Wankle blower under the condition of 1,013 mb and a temperature of 20° C. When total adiabatic efficiency (theoretical power/actual power) tests were conducted, it was found that the efficiency was improved by about 5% at 5,000 rpm with respect to the Wankel blower under the same meteorological condition as that in above-mentioned tests. When temperature increase tests were conducted, good results were obtained, i.e., a temperature difference of about −5 ° C. at 5,000 rpm, and a temperature difference of about −6° C. at 10,000 rpm, with respect to the Wankel blower.

In the above-described embodiment, the air pump according to the present invention is applied to a supercharger for a vehicle engine. However, an internal combustion engine to which the present invention is applied is not limited to the engine of general vehicle such as automobilies and may be applied to the engines of ships and aircraft. In addition, the air pump of the present invention can be applied to apparatuses other than internal combustion engines as long as they use pressurized air. Furthermore, the air pump according to the present invention can be applied not only to a displacement blower but also to a displacement compressor.

In the air pump according to the first aspect of the present invention, the outer surface between the large small arcuated surfaces of the rotor circumferential surface, i.e., the transitional surfaces crossing the virtual boundary line extending from the rotor center at an angle of 45° with respect to the central axes of the large and small arcuated surfaces, and the transitional surfaces between the large and small arcuated surfaces, are formed by the outer transitional surface constituted by a plurality of continuous convex surfaces, and the inner transitional surface constituted by a plurality of concave surfaces. With this structure, the dead space which is formed when the respective rotors are meshed with each other is formed when the outer transitional surfaces of one rotor opposes the inner transitional surface of the other rotor with the design clearance, while the leading end portion (in the rotational direction) of the large arcuated surface of one rotor opposes the leading end portion (in the rotational direction) of the small arcuated surface of the other rotor with designed clearance. Therefore, the dead space becomes a substantially crescent space.

Since the air pump of the present invention has the crescent dead space as a clearance formed between the rotors, unlike the conventional air pump, described as the former or the latter in the description of the prior art, which has an arcuated clearance, the drive resistance is slightly increased as compared with the conventional air pumps. However, in the air pump of the present invention, the design clearance, which is formed between the rotors while they roll, does not vary. For this reasons, the total adiabatic efficiency (theoretical power/actual power) can be improved, and an increased in temperature, the specific power, and the generation of noise can be suppressed, thus providing an air pump which can be highly valued in terms of practical application.

In an air pump according to the second aspect of the present invention, since the connecting portion between the outer and inner transitional surfaces, which overlaps the virtual boundary line, in the air pump according to the first aspect of the present invention is constituted by a flat surface, the variations in design clearance formed between a pair of rotors while the rotors roll can be further reduced. In addition, since the connecting portion need not be constituted by a curved surface constituted by a cycloid curve, the design of a die for an aluminum extruded body use to manufacture a rotor by extrusion is facilitated, and the labor required for quality control such as dimensional control can be reduced, thereby providing an economical air pump.

In an air pump according to the third aspect of the present invention, while the leading end portion (in the rotational direction) of the large arcuated surface of one rotor opposes the leading end portion (in the rotational direction)m of the small arcuated surface of the other rotor with the designed clearance in the air pump according to the second aspect of the present invention, the flat surface of each rotor is located at the position where the outer transitional surface of one rotor opposes the flat surface with the design clearance. With this structure, as the opposing portions of the pair of rotors, on the inlet side on which the dead space is open, the outer transitional surface of one rotor and the flat surface of the other rotor oppose each other with a predetermined clearance. For this reason, after the dead space is formed, the flat surface of the rotor is immediately separated from the outer transitional surface of one rotor to release the dead space. Therefore, the effect of discharging pressurized air pressurized by the pair of rotors is improved as compared with the air pumps described as the former and the latter in the description of the prior art.

In the air pump according to the fourth aspect of the present invention, an arcuated surface separated from the remaining surfaces by a straight line crossing the virtual boundary line at an angle of 120° is formed on the outer transitional surface in any one of the air pumps according to the first to third aspects of the present invention, while an arcuated surface as an envelope curve of the above-mentioned arcuated surface is formed on the inner transitional surface. In an air pump according to the fifth aspect of the present invention, an arcuated surface separated from the remaining surfaces by a straight line extending from the intersection, located between a straight line crossing the virtual boundary line at an angle of 120° and a straight line extending from the rotor center to an edge of a large arcuated surface, to the inner transitional surface is formed on the inner transitional surface, and an arcuated surface serving as an envelope curve of the above-mentioned arcuated surface is formed on the outer transitional surface. With this structure, the dead space formed between the respective rotors becomes a closed crescent space which has the minimum volume.

In the Wankel blower, since the inner transitional surface is constituted by a flat surface overlapping the virtual boundary line, and the outer transitional surface is constituted by a flat surface overlapping a straight line crossing the virtual boundary line at an angle of 120°, the clearance which is formed between the outer transitional surface of one rotor and the inner transitional surface of the other rotor in the radial direction when the dead space is open (the path in the dead space through which pressurized air is discharged) is elongated. In contrast to this, in the air pump of the present invention, since the arcuated surface separated by the straight line crossing the virtual boundary line at an angle of 120° is formed, the volumetric efficiency is improved, and the effect of discharging pressurized air is enhanced. In addition, if the air pump of the present invention is used as a supercharger for an internal combustion engine, the discharge efficiency is improved when the rotational speed is low. Therefore, the acceleration performance can be improved. Furthermore, exhaust gas (e.g., particles exhausted from a diesel engine) can be cleaned, thus providing great benefits in the industrial field.

What is claimed is:

1. An air pump comprising:

at least two rotors having different rotation phases and designed to come into rolling contact with each other, said rotors being rotatably contained in a rotor housing, (a) a large arcuated surface having a radius, said radius of said large arcuated surface being equal to a radius of a housing inner circumferential surface and (b) a small arcuated surface having a radius of curvature obtained by subtracting said radius of the large arcuated surface from a distance between rotational centers of said rotors being formed on an outer circumferential surface of each of said rotors, a transitional surface crossing a virtual boundary line extending from each of said rotational centers of said rotors at an angle of 45° with respect to central axes of the large and small arcuated surfaces of each of said rotors, said transitional surface being an outer surface of the outer circumferential surface of each of said rotors, said transitional surface being located between said large arcuated surface and said small arcuated surface, said transitional surface comprising an outer transitional surface, an inner transitional surface and a flat connection portion, said outer transitional surface being formed by connecting a plurality of convex-like arcuated curved surfaces, wherein a first edge of said outer transitional surface is coupled to said large arcuated surface while a second edge of said outer transitional surface is coupled to said connection portion, wherein a radius of a first one of said plurality of convex-like arcuated curved surfaces is smaller than a radius of a second one of said plurality of convex-like arcuated surfaces, and the radius of the second convex-like arcuated curved surface is larger than a radius of a third one of said plurality of convex-like arcuated curved surfaces, wherein said first convex-like arcuated curved surface is adjacent to said large arcuated surface, said inner transitional surfaces being formed by connecting a plurality of concave-like arcuated curved surfaces, wherein a first edge of said inner transitional surface is coupled to said flat connection portion while a second edge of said inner transitional surface is coupled to said small arcuated surface, wherein a radius of a first one of said plurality of concave-like arcuated curved surfaces is larger than a radius of a second one of said plurality of concave-like arcuated curved surfaces, wherein said first concave-like arcuated curved surface is adjacent to said flat connection portion, when a leading portion of said large arcuated surface of a first rotor of said rotors in a direction of rotation opposes a leading portion of said small arcuated surface of a second rotor of said rotors in the direction of rotation with a design clearance on a discharge port side, said flat connection portion between said outer and inner transitional surfaces of said second rotor being separated from said outer transitional surface of said first rotor on a suction port side, a closed space being formed between said outer transitional surface of said first and said inner transitional surface of said second rotor so that said outer transitional surface of said first rotor and said inner transitional surface of said second rotor are not matable.

2. The air pump according to claim 1, wherein at least two of said convex-like arcuated curved surfaces of each of said rotors are divided by a line-crossing at an angle of 120° with respect to said virtual boundary line.

3. The pump according to claim 2, wherein radii of said plurality of convex-like arcuated curved surfaces are different from radii of said plurality of concave-like arcuated curved surface.

4. The air pump according to claim 1, wherein said closed space forms substantially a crescent shape.

5. An air pump comprising:

at least two rotors having different rotation phases and designed to come into rolling contact with each other, said rotors being rotatably contained in a rotor housing, (a) a large arcuated surface having a radius, said radius of said large arcuated surface being equal to a radius of a housing inner circumferential surface and (b) a small arcuated surface having a radius of curvature obtained by subtracting said radius of the large arcuated surface from a distance between rotational centers of said rotors being formed on an outer circumferential surface of each of said of said rotors, a transitional surface being an outer surface of the outer circumferential surface of each of said rotors, said transitional surface being located between said large arcuated surface and said small arcuated surface, said transitional surface comprising an outer transitional surface, an inner transitional surface and a flat connection portion, said flat connection portion forming a predetermined angle with central axes of the large and small arcuated surfaces of each of said rotors, said outer transitional surface being formed by connecting a plurality of convex-like arcuated curved surfaces, wherein a first edge of said outer transitional surface is coupled to said large arcuated surface while a second edge of said outer transitional surface is coupled to said flat connection portion, wherein a radius of a first one of said plurality of convex-like arcuated curved surfaces is smaller than a radius of a second one of said plurality of convex-like arcuated curved surfaces, and the radius of the second convex-like arcuated curved surface is larger than a radius of a third one of said plurality of convex-like arcuated curved surfaces, wherein said first convex-like arcuated curved surface is adjacent to said large arcuated surface, said inner transitional surfaces being formed by connecting a plurality of concave-like arcuated curved surfaces, wherein a first edge of said inner transitional surface is coupled to said flat connection portion while a second edge of said inner transitional surface is coupled to said small arcuated surface, wherein a radius of a first one of said plurality of concave-like arcuated curved surfaces is larger than a radius of a second one of said plurality of concave-like arcuated curved surfaces, wherein said first concave-like arcuated curved surface is adjacent to said flat connection portion, when a leading portion of said large arcuated surface of a first rotor of said rotors in direction of rotation opposes a leading portion of said small arcuated surfaces of a second rotor of said rotors in the direction of rotation with a design clearance on a discharge port side, said flat connection portion between said outer and inner transitional surfaces of said second rotor being separated from said outer transitional surface of said first rotor on a suction port side, a closed space constituted by a clearance larger than the design clearance, said closed space being formed between said outer transitional surface on said first rotor and said inner transitional surface of said second rotor so that said outer transitional surface of said first rotor and said inner transitional surface of said second rotor are not matable, wherein said plurality of concave-like arcuated curved surfaces and said plurality of convex-like arcuated curved surfaces have a different radii.

6. The air pump according to claim 5, wherein said flat surface coincides with a vital boundary line extending at an angle 45° with respect to the central axes of the large and small arcuated surfaces of each of said rotors.

7. The air pump according to claim 6, wherein at least two of said convex-like arcuated curved surfaces of each of said rotors are divided by a line crossing at an angle of 120° with respect to said virtual boundary line.

8. The air pump according too claim 5, wherein said closed space forms substantially a crescent shape.

* * * * *